US009347150B2

(12) United States Patent
Fang et al.

(10) Patent No.: US 9,347,150 B2
(45) Date of Patent: May 24, 2016

(54) FILAMENT POSITIONING CONTROL DEVICE FOR COMPOSITE SPINNING OF FILAMENTS AND STAPLE FIBERS

(75) Inventors: Lei Fang, Shanghai (CN); Chunquan He, Shanghai (CN)

(73) Assignee: Shanghai Wool & Jute Textile Research Institute, Shanghai (CN)

( * ) Notice: Subject to any disclaimer, the term of this patent is extended or adjusted under 35 U.S.C. 154(b) by 310 days.

(21) Appl. No.: 14/008,102

(22) PCT Filed: Feb. 16, 2012

(86) PCT No.: PCT/CN2012/071207

§ 371 (c)(1), (2), (4) Date: Dec. 5, 2013

(87) PCT Pub. No.: WO2012/129991

PCT Pub. Date: Oct. 4, 2012

(65) Prior Publication Data

US 2014/0075915 A1 Mar. 20, 2014

(30) Foreign Application Priority Data

Mar. 31, 2011 (CN) ..... 2011 1 0079735

(51) Int. Cl.

*D01H 1/18* (2006.01)
*D01H 13/04* (2006.01)
*D01H 5/00* (2006.01)

(52) U.S. Cl.

CPC ..... *D01H 1/186* (2013.01); *D01H 5/005* (2013.01); *D01H 13/04* (2013.01); *Y10S 977/948* (2013.01)

(58) Field of Classification Search

CPC ..... D01H 1/186; D01H 5/005; D01H 13/04
USPC ..... 57/356, 357; 226/189, 190
See application file for complete search history.

(56) References Cited

U.S. PATENT DOCUMENTS 3,286,449 A * 11/1966 Carroll ..... D01H 13/04 57/12
4,286,428 A * 9/1981 Bassani ..... D06B 23/08 26/99
4,877,471 A * 10/1989 McCowin ..... B29C 53/8016 156/181
5,222,594 A * 6/1993 Sumino ..... B65G 15/08 198/807
5,768,930 A * 6/1998 Eckehard ..... B21F 1/02 72/164
6,081,972 A * 7/2000 Strobel ..... D01H 13/04 19/0.25

* cited by examiner

*Primary Examiner* — Shaun R Hurley
(74) *Attorney, Agent, or Firm* — Ware, Fressola, Maguire & Barber LLP

(57) ABSTRACT

A filament positioning control device for composite spinning of filaments and staple fibers comprises a fixed shaft and a hollow shaft mounted thereon. Left and right spiral wheels with left and right spiral grooves are mounted on the hollow shaft. Left and right positioning plates are provided on outer sides of left and right spiral wheels, each having a guide pin engaged in a spiral groove. Each positioning plate has a guide block engaged in a guide rail. As the hollow shaft is rotated, the spiral wheels rotate accordingly and the guide pins on the left and right positioning wheels move along with the spiral grooves. Because spiral grooves on two spiral wheels have different directions, when the spiral wheels rotate, the distance between positioning grooves on the two positioning plates increases or decreases, thereby changing the distance between two filaments guided by grooves on the positioning plates.

15 Claims, 5 Drawing Sheets

FILAMENT POSITIONING CONTROL DEVICE FOR COMPOSITE SPINNING OF FILAMENTS AND STAPLE FIBERS

TECHNICAL FIELD

The invention relates to a kind of yarn spinning engineering position controller, which refers to the textile industry for a filament positioning control device using the composite filament staple spinning on a ring spinning machine.

TECHNICAL BACKGROUND

There is a filament and staple fibers spinning project in our national science and technology support programs. The key points of the technical project am to compose two strands of filaments and two strands of staple fibers in composite yarn spinning, in which the filament and the staple fibers must be kept a certain distance therebetween. Currently, manufacturers use a fixed type filament positioning device to ensure that the distance between the filament and the staple fiber is fixed by using two V grooves d1 and d2 in a wheel. The distance between d1 and d2 is fixed at 20 mm, and the positioning axle d3 is also fixed in the cradle of the spinning machine see FIG. 1.

According to the principle of the filament and staple fiber spinning, the distance between the filament and the staple fiber must be adjusted within a certain length. If the distance between the two is too large, the staple fiber is too easy to escape from the strands. If the distance between the two is too small, the density and the wrapping angle of the staple fiber on the filament will not be the same, and the yarn properties will change accordingly. Obviously, a fixed yarn device can only adapt to a certain length and a certain kind of raw material.

DESCRIPTION OF THE INVENTION

The technical problem to be solved is to provide a special filament positioning distance device, which adjusts the distance between filaments and staple fibers according to the material length and the requirements of the filaments and staple fibers in the spinning production.

Technical proposal adopted by the invention to solve technical problems is as follows: Filament positioning control device of filaments and staple fibers includes a guide rail assembly and a regulating assembly fixed by the cradle of spinning machine.

Guide rail assembly is provided with a cradle fixed by a screw and a guide rail, and the two ends of the guide rail are installed by fixed bearing seats.

The regulating assembly comprises a fixed shaft with screw threads at the end, located between two fixed bearing seats. A fixed shaft is sheathed with a hollow shaft. Symmetrical left and right helical wheels are set by the hollow shaft. The left and right helical wheels are set by screws through the screw holes and the hollow shaft together; Left and right helical wheels are partially covered by left positioning plate and right positioning plate each having a positioning groove. Guide pin on each of the left and the right positioning plates falls in one of the left, right spiral grooves of the helical wheels. The guide blocks connected with the left positioning plate and the right positioning plate are engaged with the base frame rail assembly; One end of the hollow shaft is provided with an adjusting ring, and the other end is provided with a locknut. The hollow shaft is also fixed with an adjusting hand wheel, such that when the adjusting hand wheel turns, the left and right spiral helical wheels will move. Spiral grooves of left and right helical wheels promote the movement of the guide pins on the left and right positioning plates. Left and right positioning plates move axially in the guide block under the action of the left and right positioning plates; Due to the opposite directions of the right and left spiral grooves in the left and right helical wheels, the left and right positioning plates moves in opposite directions when the helical wheels rotate. As the distance between the left and right positioning grooves on the positioning plates is reduced or increased, the distance between the filaments and short fibers will change accordingly. When the distance is adjusted to the desired position, a locknut on the positioning nail is set to prevent the left and right spiral wheels from rotation in order to guarantee the accuracy of the distance. The locknuts on the left and right helical wheels can be loosened to adjust the retaining ring. The hollow shaft can be moved around so that the center of the left positioning plate and the right positioning plate coincides with the center of the spinning machine spindle, and the locknut is then locked.

The adjustment hand wheel has an engraved scale to indicate the center distance between the locating slots on the left-right positioning plates.

Comparing with the existing fixed-pitch positioning device, the present invention has the following:

1. The distance between filaments can be adjusted according to the needs of the process.
2. The dial indicates the distance between the filaments.
3. The relative position of the center of the positioning grooves and the spinning machine spindle center to accommodate the different spindle pitch of the spinning frame can be adjusted within a certain range.

REFERENCE NUMERALS

1—guide rail
2—set bolt
3—fixed bearing seat
4—locknut
5—left positioning plate
6—guide pin
7—left helical wheel
8—hollow shaft
9—right helical wheel
10—set screw
11—screw hole
12—fixed shaft with threaded end
13—fixed bearing seat hole
14—adjustment retaining ring
15—adjustment wheel
16—right positioning plate
17—left spiral groove

18—right spiral groove
19—guide block
20—base frame screw holes
21—retaining bolt
a1—cradle of spinning machine
a2—front leather roller of spinning machine
a3—front roller of spinning machine
b1—left staple fiber segment
b2—right staple fiber segment
c1—left filament
c2—right filament
d1—current fixed type filament positioning wheel left V groove
d2—current fixed type filament positioning wheel right V groove
d3—positioning shaft

EMBODIMENTS FOR CARRYING OUT THE INVENTION

Figure 2:
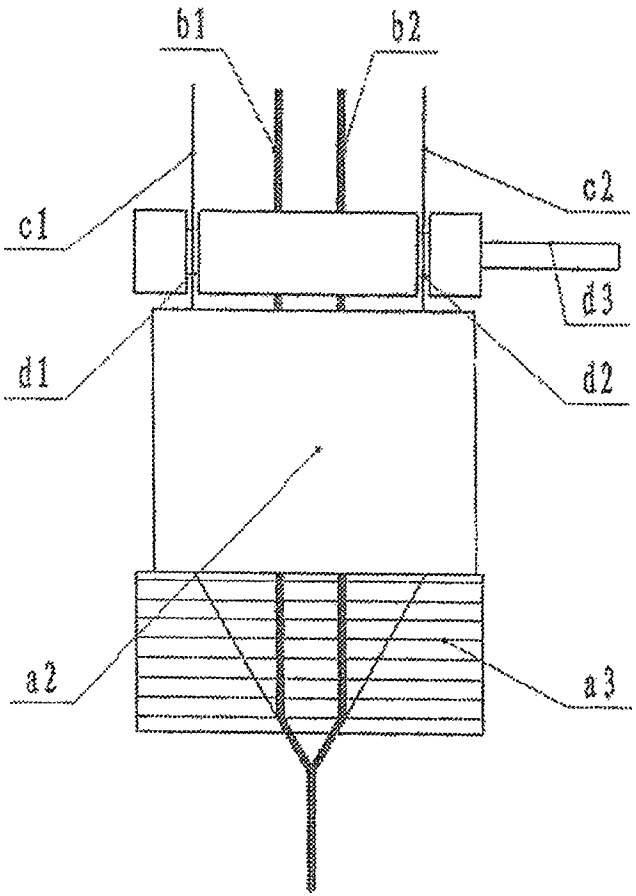
FIG. 2 is a schematic view of the filament staple fiber composite spinning.
Figure 1:
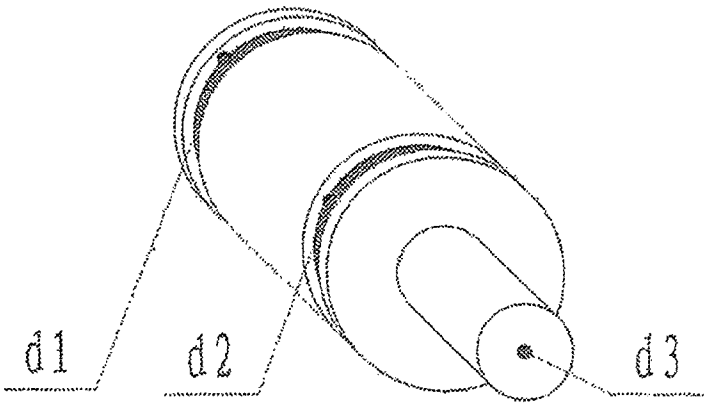
FIG. 1 (PRIOR ART)
FIG. 1 is a schematic structural view of the existing fixed positioning wheel.
Figure 3:
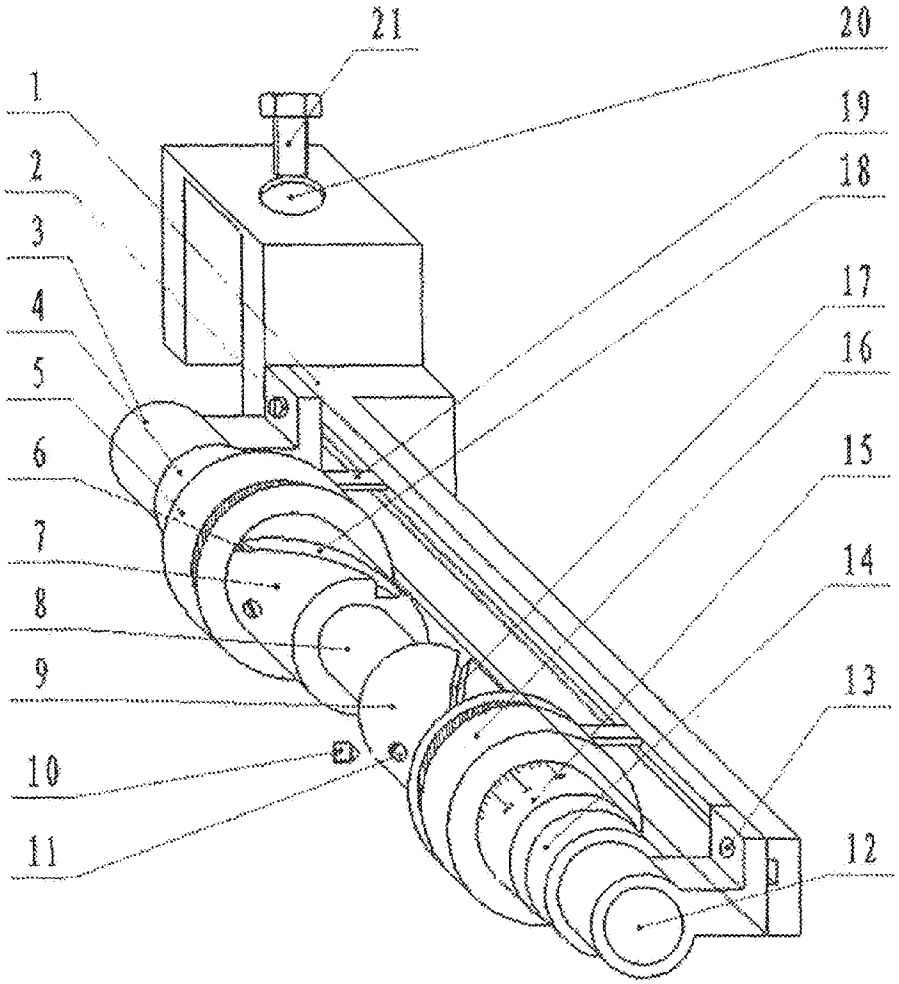
FIG. 3 is a schematic block diagram of the present invention.
Figure 4:
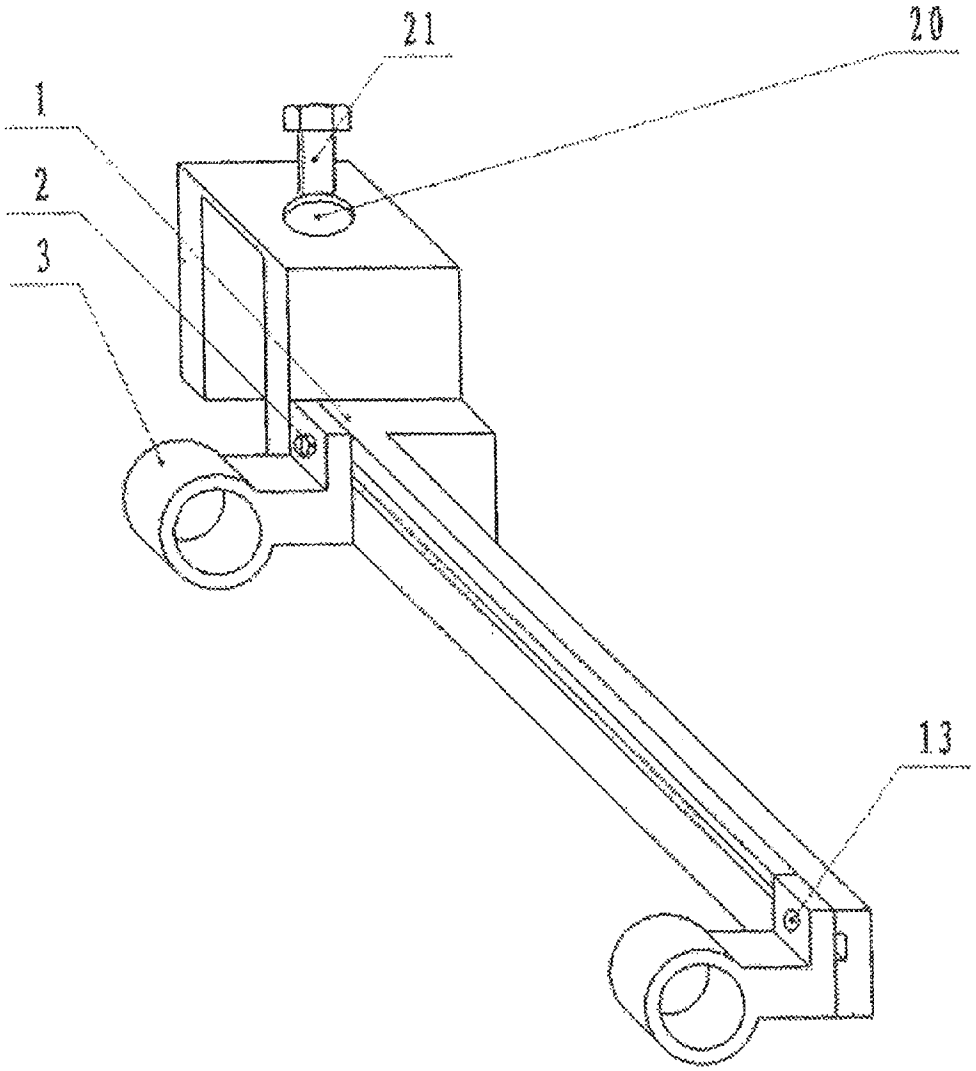
FIG. 4 is a schematic block diagram of the base frame rail assembly.
Figure 5:
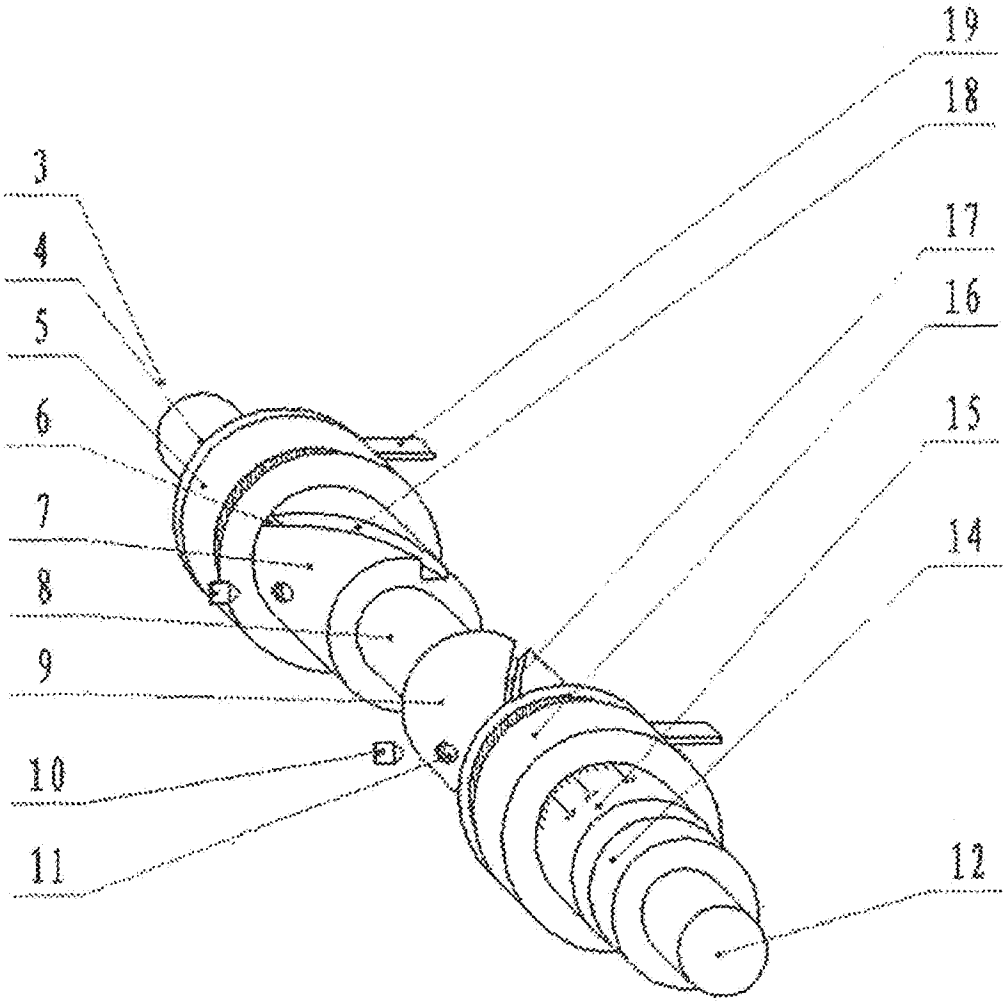
FIG. 5 is a schematic structural view of the adjustment assembly.
Figure 6:
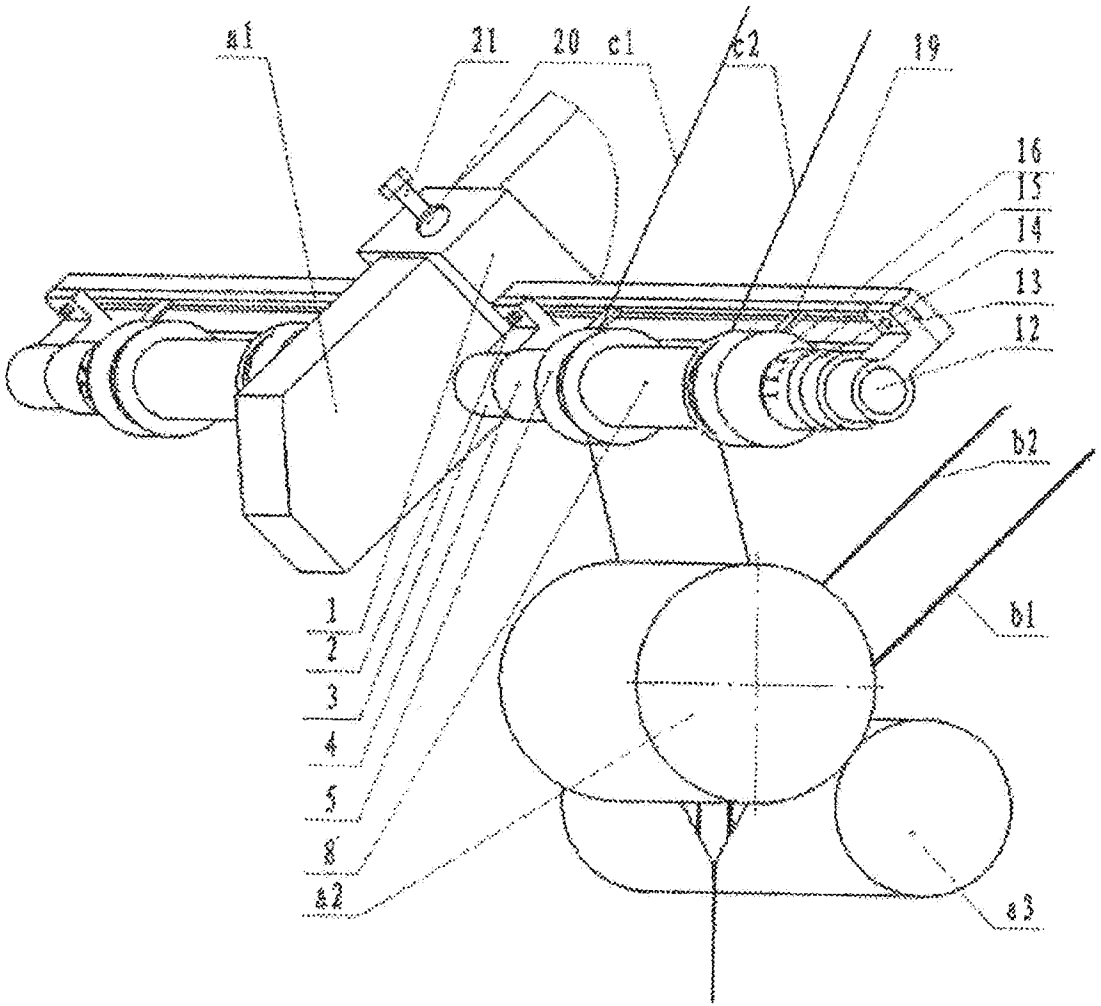
FIG. 6 is a spinning frame of the present invention in schematic view.

Implementation of the device is shown in FIG. 3 and FIG. 6.

Through the base frame screw hole 20, base frame rail assemblies are fixed with the retaining bolt 21 and the spinning frame cradle a1 altogether. Fixed bearing seat 3 through a set bolt 2 and fixed bearing seat hole 13 is fixed with guide rail 1. A fixed shaft 12 with a threaded end is mounted between two fixed bearing seats 3. A guide block 19 connected with the left and right positioning plates 5, 16 is engaged in the guide rail 1. Hollow shaft 8 is sheathed on the fixed shaft 12, and the left and right helical wheels 7, 9 are mounted on the hollow shaft 8 by set screws 10 through the screw holes 11. The left and right positioning plates 5, 16 are separately mounted on the outer sides of the left and right helical wheels 7 and 9. The guide pin 6 on each of the left and right positioning plates 5, 16 falls within the left spiral groove 17 and the right spiral groove 18.

Filaments c1 and c2 enter into the front jaw of the spinning frame through the positioning grooves on the left and right positioning plates 5, 16 and then separately combined with the staple fibers b1 and b2.

Rotating the adjustment wheel 15 mounted in the hollow shaft 8 causes the left and right helical wheels 7, 9 to rotate. Due to the left, the right spiral grooves 17, 18 on the helical wheels being in different directions, as the helical wheel is rotated, the guide pins 6 on the left and right positioning plate 5, 16 move along with the left and right spiral grooves 17, 18, and the guide pins 6 connected to the left and right positioning plate 5, 16 do inward or outward movement. The distance between the positioning grooves on the left and right positioning plates 5, 16 decreases or increases, thereby changing the distance between filament c1 and c2 and the staple fibers b1 and b2. The moved distance is indicated by the engraved scale on the adjustment wheel 15. After the adjustment is in place, the positioning pin on the locking nut 4 can be set to prevent the rotation of the left and right helical wheels 7, 9.

If the center of the filaments c1, c2 and spinning machine spindle center do not coincide, it is possible to loosen the lock nut 14 and adjust the adjustment retaining ring 14 to move the hollow shaft 8 around until the center of filaments c1, c2 coincides with the center of the spinning machine spindles, the locknut 4 on the threaded end of the fixed shaft 12 can then be fastened to prevent the hollow shaft 8 from moving along the shaft.

What is claimed is:

1. A method for adjusting a distance between a first positioning plate and a second positioning plate in a filament positioning control device, said method comprising:

providing a first guide pin on the first positioning plate and a second guide pin on the second positioning plate;

providing a first spiral wheel comprising a first spiral groove and a second spiral wheel comprising a second spiral groove;

engaging the first guide pin in the first spiral groove and the second guide pin in the second spiral groove, the first and second spiral wheels arranged for simultaneous rotation about a shaft in a first direction or an opposing second direction, wherein when the first and second spiral wheels are rotated in the first direction, the first and second spiral grooves cause the first and second positioning plates to move towards each other, and when the first and second spiral wheels are rotated in the second direction, the first and second spiral grooves cause the first and second positioning plates to move away from each other, wherein each of the first and second positioning plates comprises a positioning groove configured to position a filament for spinning.

2. The method according to claim 1, wherein the first and second spiral wheels are secured on a cylindrical member mounted over the shaft, the cylindrical member configured to rotate about the shaft for rotating the first and second spiral wheels and changing the distance between the first positioning plate and the second positioning plate.

3. The method according to claim 2, wherein the filament position device comprises a guide rail assembly comprising a guide rail and two mounting seats for fixedly mounting the shaft substantially parallel to the guide rail, and wherein each of the first and second positioning plates comprises a guide block, said method comprising:

engaging the guide block of the first positioning plate and the guide block of the second positioning plate to the guide rail so as to allow the first and second positioning plates to move relative to each other when the cylindrical member is caused to rotate.

4. The method according to claim 3, wherein the first positioning plate comprises a positioning groove configured to position a first filament and the second positioning plate comprises a positioning groove configured to position a second filament for spinning with spinning with staple fibers and wherein the distance between the first and second positioning plates dictates a distance between the staple fibers and the first and second filaments.

5. The method according to claim 4, further comprising:

fastening the cylindrical member for preventing the first and second positioning plates from movement when the distance between the staple fibers and the first and second filaments has been adjusted.

6. The method according to claim 4, further comprising:

providing an adjustment wheel on the cylindrical member, the adjustment wheel arranged to cause the first and second spiral wheels to rotate in the first direction or the second direction.

7. The method according to claim 6, wherein the adjustment wheel comprising a scale to indicate a moved distance between the first and second positioning plates.

8. A filament positioning control device for use in composite spinning of filaments and staple fibers, comprising:

a first spiral wheel comprising a first spiral groove;

a second spiral wheel comprising a second spiral groove;

a first positioning plate comprising a first guide pin arranged for engagement in the first spiral groove;

a second position plate comprising a second guide pin arranged for engagement in the second spiral groove, wherein the first spiral wheel and the second spiral wheel are arranged for simultaneous rotation about a shaft in a first direction or in an opposing second direction such that when the first and second spiral wheels are caused to rotate in the first direction, the engagement of the first guide pin in the first spiral groove and the engagement of the second guide pin in the second spiral groove cause the first and second positioning plates to move towards each other, and when the first and second spiral wheels are caused to rotate in the second direction, the engagement of the first guide pin in the first spiral groove (18) and the engagement of the second guide pin in the second spiral groove cause the first and second positioning plates to move away from each other, wherein each of the first and second positioning plates comprises a position groove configured to position a filament for spinning.

9. The filament positioning control device according to claim 8, further comprising:

a cylindrical member mounted over the shaft (12), the cylindrical member configured to rotate over the shaft for rotating the first and second spiral wheels and changing a distance between the first and second positioning plates.

10. The filament positioning control device according to claim 9, further comprising:

a guide rail assembly comprising a guide rail and two mounting seats for fixedly mounting the shaft substantially parallel to the guide rail, wherein each of the first and second positioning plates comprises a guide block configured for engagement with the guide rail so as to allow the first and second positioning plates to move relative to each other when the cylindrical member is caused to rotate.

11. The filament positioning control device according to claim 10, wherein the first positioning plate comprises a positioning groove configured to position a first filament and the second positioning plate comprises a positioning groove configured to position a second filament for spinning with staple fibers, and wherein the distance between the first and second positioning plates dictates a distance between the staple fibers and the first and second filaments.

12. The filament positioning control device according to claim 10, wherein the guide rail assembly is fixedly attached to a cradle of a spinning machine.

13. The filament positioning control device according to claim 11, wherein the spinning machine comprises a spindle center, and wherein the cylindrical member is configured for axial movement along the shaft for adjusting a center between the first and second such that the center between the first and second coincides with the spindle center, said control device further comprising:

a retaining ring arranged to move the cylindrical member along the shaft for said adjusting; and a fastener arranged to fasten the cylindrical member to the shaft so as to prevent the cylindrical member from moving along the shaft.

14. The filament positioning control device according to claim 11, further comprising an adjustment wheel mounted to the cylindrical member, the adjustment wheel arranged to cause the first and second spiral wheels to rotate in the first direction or the second direction.

15. The filament positioning control device according to claim 14, wherein the adjustment wheel comprises a scale to indicate a moved distance between the first and second positioning plates.

* * * * *